US007455174B2

(12) United States Patent
Cuomo

(10) Patent No.: US 7,455,174 B2
(45) **Date of Patent: *Nov. 25, 2008**

(54) CARRIER AND METHOD

(75) Inventor: Angelo V. Cuomo, Staten Island, NY (US)

(73) Assignee: E-Z Media, Inc., New York, NY (US)

( * ) Notice: Subject to any disclaimer, the term of this patent is extended or adjusted under 35 U.S.C. 154(b) by 75 days.

This patent is subject to a terminal disclaimer.

(21) Appl. No.: 11/506,231

(22) Filed: Aug. 17, 2006

(65) Prior Publication Data

US 2007/0029211 A1 Feb. 8, 2007

Related U.S. Application Data

(63) Continuation-in-part of application No. 11/443,962, filed on May 30, 2006, and a continuation-in-part of application No. 11/345,898, filed on Feb. 2, 2006, and a continuation-in-part of application No. 11/301,407, filed on Dec. 13, 2005, and a continuation-in-part of application No. 11/301,913, filed on Dec. 13, 2005, and a continuation-in-part of application No. 11/012,789, filed on Dec. 15, 2004, now Pat. No. 7,370,755, and a continuation-in-part of application No. 11/012,440, filed on Dec. 15, 2004, now Pat. No. 7,383,949, and a continuation-in-part of application No. 10/939,264, filed on Sep. 10, 2004, and a continuation-in-part of application No. 10/737,612, filed on Dec. 16, 2003, now Pat. No. 7,267,224, and a continuation-in-part of application No. 10/662,265, filed on Sep. 15, 2003, now Pat. No. 7,243,785, and a continuation-in-part of application No. 10/215,938, filed on Aug. 9, 2002, now Pat. No. 7,185,758.

(51) Int. Cl.
*B65D 75/00* (2006.01)

(52) U.S. Cl. ..... 206/175; 206/187; 206/188

(58) Field of Classification Search ..... 206/142, 206/143, 144, 167, 170, 175, 180, 188, 190, 206/192, 193, 200, 427, 187
See application file for complete search history.

(56) References Cited

U.S. PATENT DOCUMENTS 2,011,232 A 8/1935 Parks
2,513,079 A 6/1950 Buerger (Continued)

*Primary Examiner*—Luan K Bui
(74) *Attorney, Agent, or Firm*—Kramer Levin Naftalis & Frankel LLP; Gregor N. Neff, Esq.

(57) ABSTRACT

A carrier blank and method of making a carrier which is highly adaptable for use in different forms with both in-line and right-angle gluers presently in use by many carrier manufacturers. A blank for use with a variety of different right-angle gluers takes advantage of the structure of the carrier which has two separate support panels and receptacles. The parts for the carrier can be formed into a compact lay-out in two parallel arrays on opposite sides of the blank. Cut-outs forming dividers for each of the receptacles are nested and embedded in adjacent parts so as to form integral one-piece dividers. A manufacturer can select among several different blanks available for use on either in-line or right-angle gluers, all for producing essentially the same carrier.

13 Claims, 3 Drawing Sheets

U.S. PATENT DOCUMENTS

Figure 1:
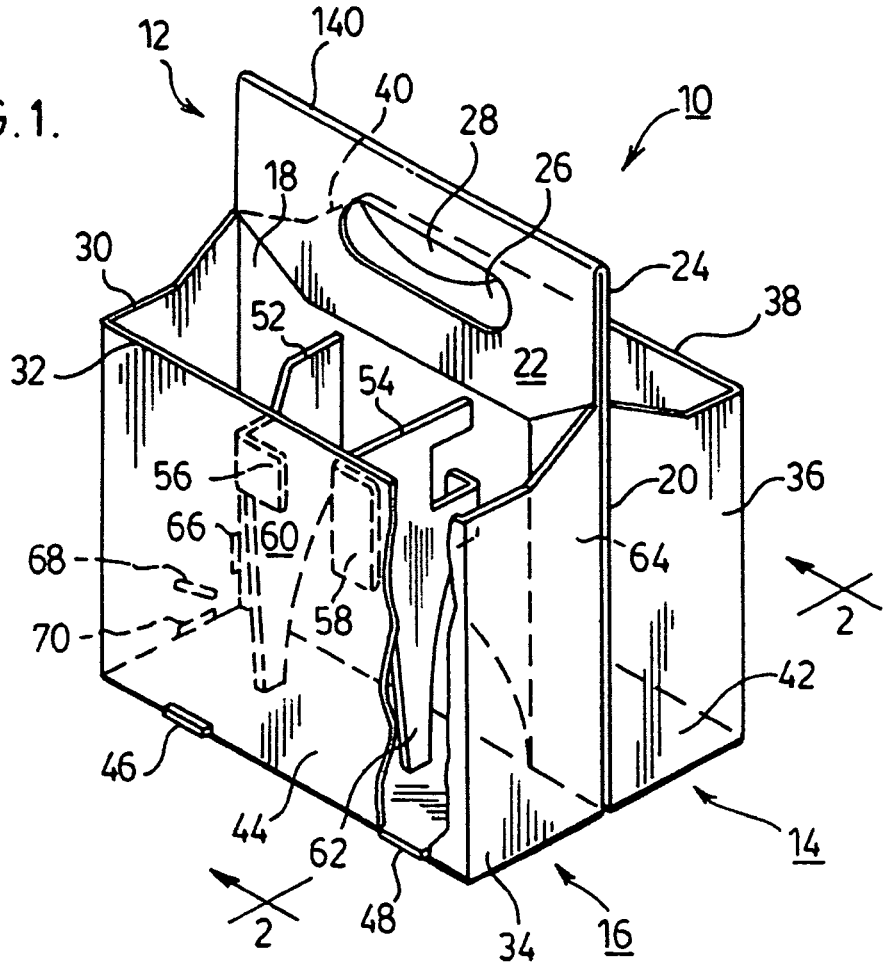

| | | | | | |
|---|---|---|---|---|---|
| 2,630,264 | A | | 4/1953 | Holy | |
| 3,158,286 | A | | 11/1964 | Phillips, Jr. | |
| 4,319,682 | A | * | 3/1982 | Wright et al. | 206/180 |
| 4,378,880 | A | | 4/1983 | Summers | |
| 4,610,349 | A | | 9/1986 | Schwartz et al. | |
| 4,767,051 | A | | 8/1988 | Single | |
| 4,770,294 | A | | 9/1988 | Graser | |
| 4,836,367 | A | | 6/1989 | Golkar | |
| 5,579,904 | A | * | 12/1996 | Holley, Jr. | 206/180 |
| 5,695,051 | A | | 12/1997 | Hart | |
| 5,709,298 | A | | 1/1998 | Harris | |
| 5,927,502 | A | | 7/1999 | Hunter | |
| 6,341,689 | B1 | | 1/2002 | Jones | |
| 6,443,308 | B1 | | 9/2002 | Davis | |
| 7,267,224 | B2 | * | 9/2007 | Cuomo | 206/175 |

* cited by examiner

CARRIER AND METHOD

This patent application is a continuation-in-part of U.S. patent applications Ser. No. 10/215,938 filed Aug. 9, 2002; now U.S. Pat. No. 7,185,758; Ser. No. 10/662,265, filed Sep. 15, 2003; U.S. Pat. No. 7,243,785; Ser. No. 10/737,612 filed on Dec. 16, 2003; U.S. Pat. No. 7,267,224; Ser. No. 10/939,264 filed on Sep. 10, 2004, Ser. No. 11/012,440 filed on Dec. 15, 2004, U.S. Pat. No. 7,383,949; Ser. No. 11/012,789, filed Dec. 15, 2004, U.S. Pat. No. 7,370,755; Ser. No. 11/301,913, filed Dec. 13, 2005, Ser. No. 11/301,407, filed Dec. 13, 2005, Ser. No. 11/345,898, filed Feb. 2, 2006, and Ser. No. 11/443,962, filed May 30, 2006. The disclosures of those patent applications are hereby incorporated herein by reference.

This invention relates to carriers for carrying food, beverages in cups, bottles, and cans, and particularly to pre-packaged six-pack carriers.

In the manufacture of fiberboard carriers used in the past as pre-packaged six-pack carriers for bottled beverages, automated manufacturing equipment has been used. Some of such equipment includes straight-line gluing machines and right-angle gluing machines. Both types of equipment are in widespread use.

The straight-line gluers usually are capable of handling a longer carrier blank, which has tabs and flaps to be glued predominantly in a straight line along one edge of the blank.

Right-angle gluers often cannot accommodate as long a blank as the straight-line gluers. They typically apply glue in a first step with the blank moving through the gluer in one direction, and then the blank is rotated 90° and goes through the gluer in a direction perpendicular to the first direction.

Both types of equipment usually are relatively expensive and therefore should be used for as long as possible in order to amortize the purchase cost over the largest number of units of production possible, and thus maximize manufacturing profit.

Therefore, it is an object of the present invention to provide a set of blanks particularly adapted for use in right-angle gluers, in order to complement the provision of linear blanks for linear gluers, as shown in my above-identified U.S. patent application Ser. No. 11/012,440 filed Dec. 15, 2004, thereby providing a choice of different blanks to produce substantially the same carrier with almost equal facility on either type of equipment.

It is a further object of the invention to provide such a blank and a method of using it which is highly adaptable to the locations of glue heads and other configurations of existing right-angle gluers so as to minimize the changes required to manufacture the carriers of the invention and maximize the useful lifetime of such equipment.

It is another object of the invention to maximize the utilization of existing machinery, including both in-line and right-angle gluers, for each of a wide variety of manufactures so as to maximize the utility and profit for the manufactures of the carrier of the invention.

The foregoing objects are met by the provision of right-angle gluer blanks in which a plurality of flanges forming two separate receptacles secured to two vertical support panels are arranged in parallel rows on a blank, together with the vertical support panels. The flanges for the two receptacles, and other foldable parts of the carrier are glued in a first path through the gluing machine in a first direction. Then, the blank is rotated and sent through the gluer in a second direction perpendicular to the first direction to finish the gluing operation.

The carrier is folded at appropriate times in the process to insure that the glue-bearing surfaces adhere to the desired areas of the carrier panels when the folds are made.

In accordance with the invention, the manufacturer can select either in-line blanks or right-angle blanks to use on various pieces of equipment the manufacturer already owns. In addition, should the manufacturer need to acquire more equipment, the manufacturer can select among the various types of blanks and make an appropriate gluing machine purchase.

As a result, a high level of utilization of existing equipment, efficiency of manufacturing and relatively low cost are facilitated.

The foregoing and other objects and advantages of the invention will be set forth in or become apparent from the following description and drawings.

IN THE DRAWINGS

Figure 2:
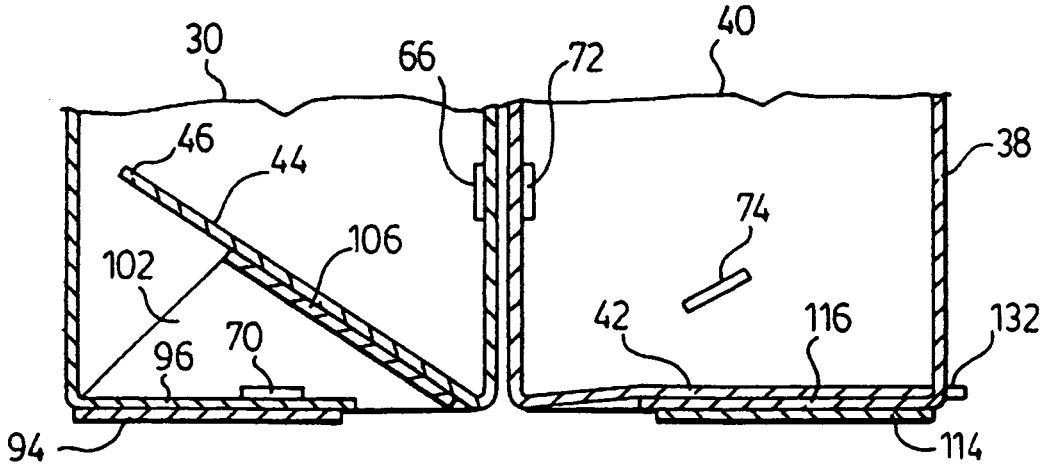

FIG. 1 is a partially broken-away perspective view of a carrier constructed in accordance with the present invention;

FIG. 2 is a cross-sectional broken-away view taken along line 2-2 of FIG. 1; and FIGS. 3, 4, 5, and 6 are top plan views of different blanks which can be used to manufacture the carrier shown in FIGS. 1 and 2 with right-angle gluers.

The carrier shown in FIGS. 1 and 2 is substantially the same as that shown in my above-identified U.S. patent applications, and particularly U.S. Ser. No. 10/929,264 filed Sep. 10, 2004, in FIGS. 48 and 55 of the drawings.

The carrier 10 shown in FIG. 1 includes a vertical support structure 12 including two back-to-back support panels 18 and 20, with reinforcement panels 22 and 24 glued onto their upper portions.

A hand-hole 26 with a hand guard 28 are provided in the reinforced upper region of the vertical support structure 12.

Two separate receptacles 14 and 16 are provided. One is secured to the support panel 18, and the other to the support panel 20.

Receptacle 16 includes relatively short side wall 30, a long side wall 32, and a short side wall 34. Similarly, receptacle 14 includes side walls 36, 38, and 40, with side walls 36 and 40 being relatively shorter than side wall 38.

A bottom wall structure is provided for each of the receptacles. The top panel of the bottom wall structure for receptacle 14 is panel 42, and the top panel for the bottom of the receptacle 16 is panel 44.

Figure 3:
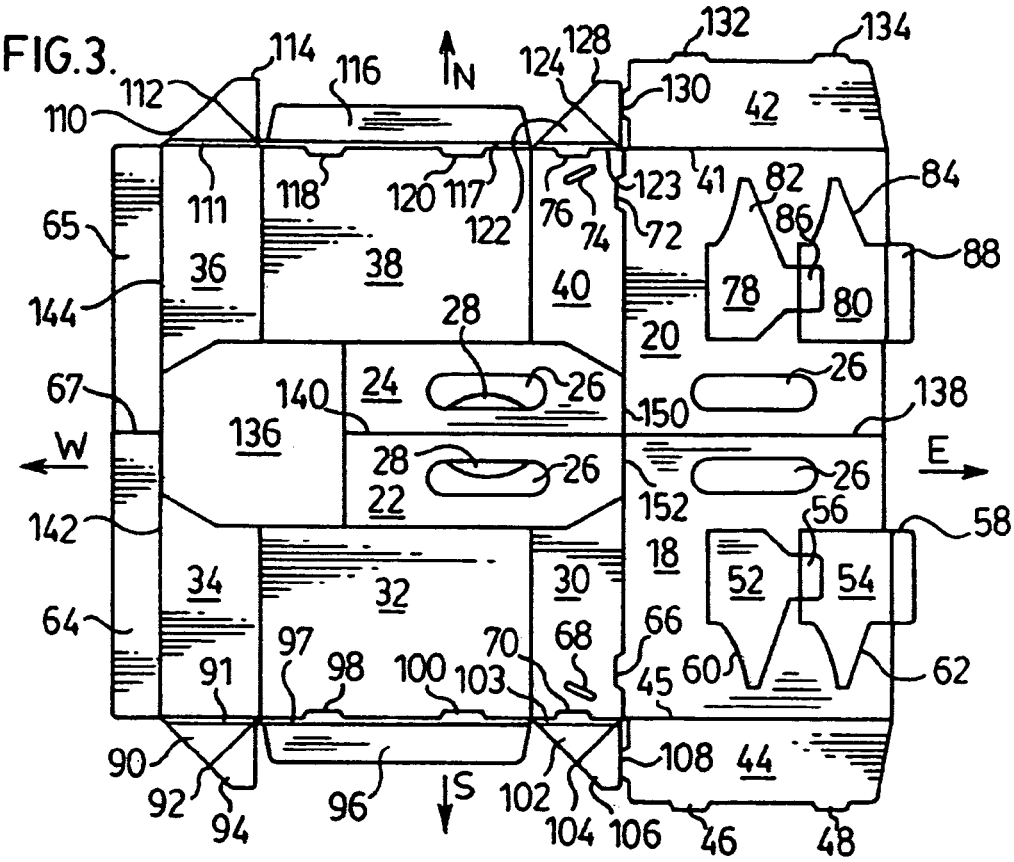

Each receptacle has a pair of dividers. The receptacle 16 has dividers 52 and 54, and receptacle 14 has dividers 78 and 80 (FIG. 3). The dividers for the receptacle 14 are not shown in FIG. 1 for the sake of clarity in the drawings.

Each of the four dividers has a glue tab 56 or 58 or 86 and 88 (FIG. 3) and a tapered, downwardly-extending lower portion 60 or 62, or 84 or 86 (FIG. 3). The glue tabs are glued to the inside of the long side wall 32 or 38 to hold them in place.

As it is described more fully in my above-identified prior patent applications, the top panel 42 or 44 in the bottom wall of each receptacle is a broad panel which spans the entire width of the bottom structure; that is, the width of the bottom structure from the panel 18 or 20 out to the long side wall 32 or 38 of each receptacle.

Preferably, each panel 42 or 44 engages with a narrow side wall 30 or 40 of one of the receptacles, as the carrier is being unfolded. Thus, the receptacle is held open so as to prevent it from relapsing into a folded condition.

Three slots are provided at 66, 68, and 70 in the wall 30, and at 72, 74, and 76 in the wall 40 (see FIG. 3). Also, a tab 108 or 130 extends from the side of the top bottom panel 44 or 42 (see FIG. 3). This tab rests in the vertical slot 66 or 72 when the carrier is folded up, and, as the carrier is unfolded, the tab slips into the slot 68 or 74, which is in an angular position such as that shown by the panel 44 in FIG. 2. In this position it remains until a bottle or other object placed in the carrier forces the panel 42 or 44 down completely. When it reaches the bottom position, the tab 108 or 130 slips into the slot 70 or 76 which extends horizontally. This helps to hold the panel 42 or 44 in place without shifting when the loaded carrier is moved about.

Also holding the panels 42 and 44 in place are tabs 46 and 48 and 132 and 134 which extend outwardly from the outer edges of the panels through slots 98, 100 or 118, 120.

As it is described in greater detail in my above-identified patent application Ser. No. 10/939,264, filed Sep. 10, 2004, the material forming the dividers 52, 54, 78, and 80 is cut out of the two vertical support panels 18 and 20, and, in some embodiments, a small amount of adjacent panels as well.

In the blank shown in FIG. 3, the glue tabs 56, 58, or 86, 88 of the dividers extend away from the main body of the divider in a direction towards the right in FIG. 3. For convenience, the blanks shown in FIGS. 3, 4, 5, and 6 will be designated with direction arrows indicating North, South, West and East as reference directions. Thus, the divider structures in FIG. 3 extend from West to East.

Advantageously, the glue tab ends 56 and 86 of the centrally-cut-out divider panels 52 and 78 extend into the material forming the other divider 54 or 80. Thus, the panels forming these dividers can be said to be "nested" within one another. This is highly advantageous and allows the provision of integral, one-piece foldout dividers which are difficult to provide within the size limitations dictated by the sizes of the normal beverage bottles to be carried. The tabs 58 and 88 can be seen to extend beyond the East edges 139, 141 of the support panels 18 and 20.

At the left or West end of the blank shown in FIG. 3 are provided two fairly wide glue flaps or flanges 64 and 65 joined along fold line 67. The flanges 64 and 65 are secured to the West edges of the panels 34, 36 along fold lines 142 and 144.

The flanges forming the two bottom structures for the receptacles 14 and 16 also are shown in FIG. 3. In the bottom structure for the receptacle 16, a flange extends downwardly from each of the three side walls 32, 34, and 30 as well as the vertical panel 18. Thus, flange 44 is secured to the bottom edge of the panel 18 along a fold line 45, and flange 42 is secured to the bottom edge of panel 20 along fold line 41.

Attached along the bottom edge of panel 34 along a fold line 91 is a triangular flange 90 with a truncated triangular glue tab 94, with the two being attached together along a fold line 92.

Similarly, attached along fold line 103 is a triangular flange 102 with a truncated triangular glue tab 106, attached to flange 102 along a fold line 104.

A relatively narrow but longer flange 96 is attached to the lower edge of side wall panel 32 along a fold line 97.

Similarly, a triangular flange 110 is connected along fold line 111 to the bottom edge of side wall panel 36, and a truncated triangular glue tab is joined to the flange 110 along a fold line 112.

Another triangular flange extends from the bottom edge of the side wall panel 40 along a fold line 123, and has a truncated triangular glue tab 128 secured to it along a fold line 124.

Finally, another relatively narrow but long flange 116 like flange 96 is secured to the bottom edge of panel 38 along a fold line 117.

The reinforcing panels 22 and 24 are secured at their East edges to the vertical panels 20 and 18, respectively, along fold lines 150 and 152. A fold line 140 between the two panels 22 and 24 is provided so as to form the upper edge of the handle structure when the carrier is assembled, as shown in FIG. 1.

The area 136 is open space. The reinforcement panels 22 and 24 are cut to be separate from the upper edges of panels 38, 40, 30, and 32.

In manufacturing a carrier from the blank shown in FIG. 3 using a right-angle gluer, the blank, after being die cut from a sheet, is fed into the gluer in a westerly direction; that is, from East to West. Prior to that, the flanges and other surfaces to be glued in the first step are folded over as necessary. Specifically, the flanges 44, 102, 96, and 90 are folded upwardly to the North, towards the horizontal center line 138 of the blank. The flanges 42, 122, 116, and 110 are folded towards the center line 138.

The flanges 64 and 65 are not folded at this time.

Then, the glue tabs 94, 106, 114, and 128 are folded along fold lines 92, 104, 112, or 124 towards the centerline 138 so that the under surface of each of the glue tabs is facing upwardly to receive glue.

Then, the blank is moved through the right-angle gluer from East to West, at which time properly pre-positioned glue heads apply adhesive to the proper areas, thus placing glue upon the tabs 86 and 88, 56 and 58 of the dividers; the tabs 106, 94, 114, 128 of the bottom structures, the flanges 64 and 65, and the reinforcement panels 22 and 24. Glue is not applied to the portions of the flanges 64, 65 that will contact the divider cutouts later in a subsequent folding step.

Next, the blank is folded from East to West along fold lines 150 and 152. This causes the glue tabs 86, 88, 56, 58, 106 and 128, and panels 22 and 24 to adhere at the proper locations on the panels to which they are to be secured.

Next, the panels 34 and 36, with the flanges 64, 65 are folded from West to East along fold lines 146, 148, so that glue tabs 94, 114 adhere to panels 96 and 116, respectively, and flanges 64, 65 adhere to the panels 18 and 20 at the East edges 139 and 141, but do not adhere to the divider cut-outs.

Next, the blank shown in FIG. 3 is rotated 90° counterclockwise, and then is moved from North to South, that is, in a direction perpendicular to the original direction of movement, during which glue is applied to the panels 18 and 20. Then, the two halves of the blank are folded along the line 138 so that the two vertical panels are glued together back-to-back. The folded carrier now is complete and ready to pack and ship to a bottler or other user.

Figure 4:
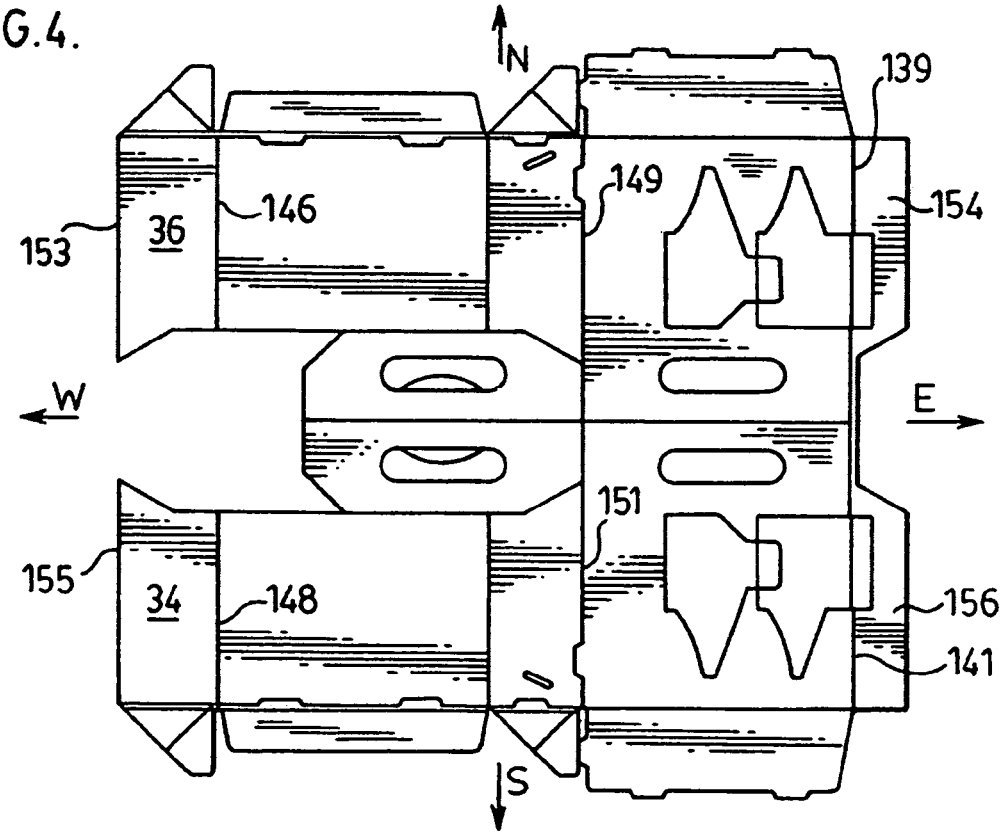

In accordance with the present invention, accommodation is made for a variety of different glue head configurations in right-angle gluers. For example, FIG. 4 shows the same blank as in FIG. 3, except that the flanges 64 and 65 on the West edge of the blank have been replaced by flanges 154 and 156 on the East edges of the blank. This accommodates the needs of gluers in which it is easiest to apply glue to the various locations where it is required by having the flanges at the East edge instead of the West edge.

The process of folding and gluing the FIG. 4 blank is the same as for the FIG. 3 blank, except that the flanges 154, 156 are not glued before the first fold along lines 149, 151. However, the backs of the flanges are glued after the first fold so that, after the second fold, along lines 146, 148, the flanges 154, 156 will adhere, respectively to the West edges 153, 155 of the panels 36 and 34.

Figure 5:
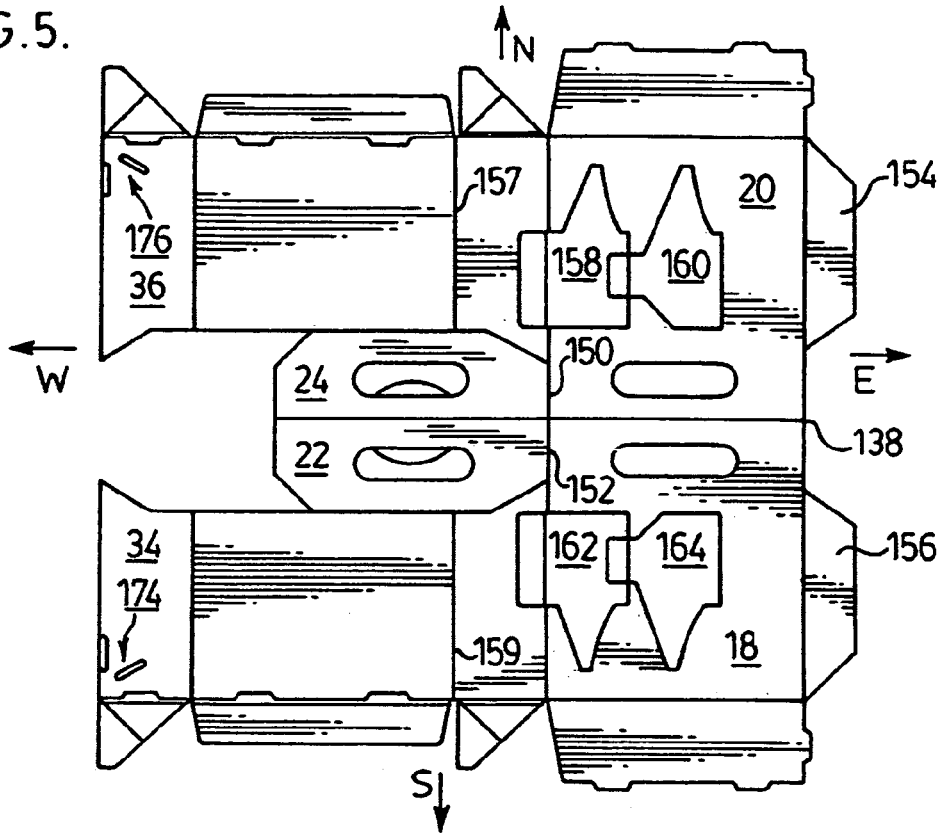
Figure 6:
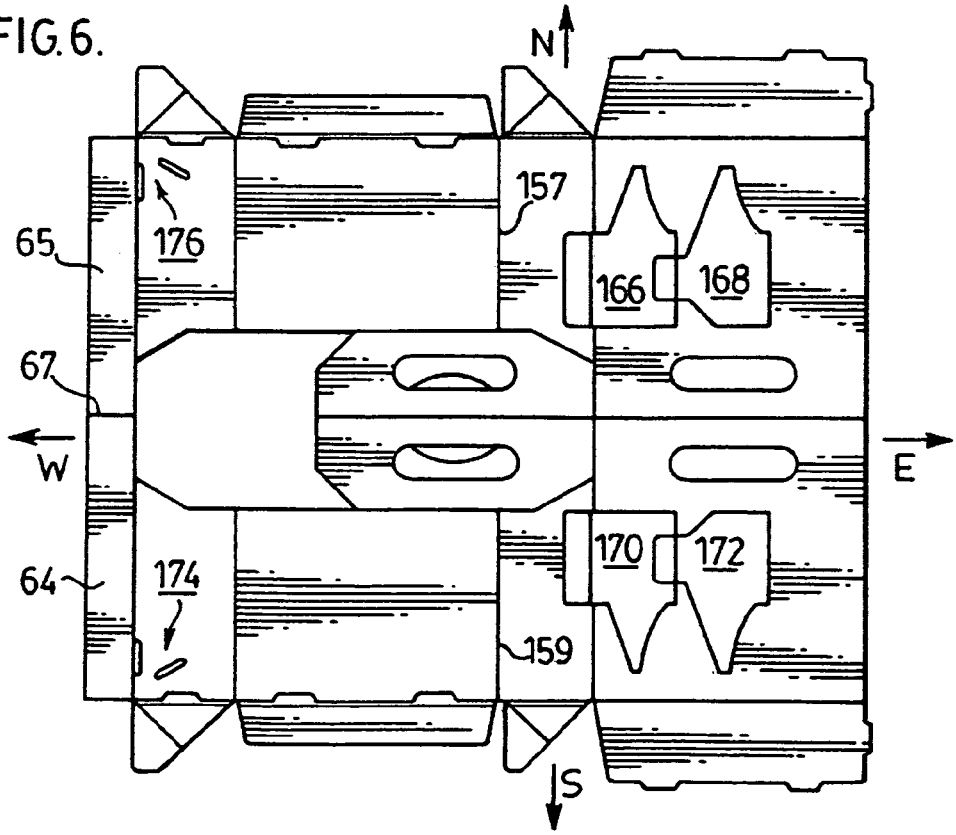

FIGS. 5 and 6 show two additional embodiments of the blank structure. These blanks are the same as that shown in FIG. 3 except that the bottom flanges are reversed in direction, the slot groups 174 and 176 are changed in position, and the four divider cut-outs 158, 160, 162, and 164 point to the West instead of to the East. The flanges 154 and 156 are on the East edge of the blank, as in the FIG. 4 embodiment.

The folding and gluing of the FIG. 5 blank is different from those described above.

The flanges 154 and 156 are folded and glued in the first step in which the bottom flanges are folded and glued, and the divider glue tabs and reinforcement panels 24, 22 are glued.

In the first fold, the panels 18, 20, etc., are folded from East to West along lines 157,159, and the flanges 154, 156 adhere near the West edges of panels 36, 34, and the bottom and divider tabs are adhered to their target areas.

In the second fold, the reinforcement panels 22, 24 are folded from West to East along lines 150, 152 to adhere to the panels 18 and 20, respectively.

Then the blank is rotated and the panels 18, 20 are glued and folded together along line 138 to finish the carrier.

The FIG. 6 blank is the same as the FIG. 5 blank except that the flanges 64, 65 are folded and glued during the first step instead of the flanges 154 and 156.

The end flanges and panels are given different shapes, in some cases, in order to avoid covering parts which are not intended to be covered.

If it is not desired to secure the support panels 18, 20 back-to-back but to leave them hinged along line 138 so as to allow them to carry advertising and promotional matter on the surfaces, one merely omits the rotating step, the support panel gluing step, and if shipment of the carriers in partially-folded form is either desired or acceptable, the final fold step along line 138 also can be omitted.

It should be evident that various permutations and combinations of locations of parts can be selected, in accordance with the present invention, to facilitate the utilization of specific glue head orientations of existing equipment, to maximize the through-put through the machines, or for other beneficial manufacturing reasons. The flexibility of the blank structure permits making these changes.

The above description of the invention is intended to be illustrative and not limiting. Various changes or modifications in the embodiments described may occur to those skilled in the art. These can be made without departing from the spirit or scope of the invention.

What is claimed is:

1. A blank for forming a foldable carrier, said blank comprising (a) a pair of support panels each having opposed side edges extending in a first direction, and first and second opposed transverse end edges extending in a second direction transverse to said first direction, said support panels being arranged with said side edges aligned with one another, and the first of said transverse end edges of each panel adjacent and parallel to the first of said transverse end edges of the other of said support panels, (b) a pair of side-wall structures for forming two receptacles, each secured to one of said support panels, (c) each of said side-wall structures comprising a plurality of side-wall panels joined together in series with one of said support panels along fold lines, (d) each of said side-wall panels and said support panels having a bottom flange extending outwardly from one edge, said flanges forming two linear groups of four bottom flanges extending outwardly from opposite sides of said blank, (e) at least two of said flanges in each of said groups having an attachment corner with a diagonal fold line, whereby said corner can be attached to an adjacent one of said flanges to form an automatically-opening bottom structure of one of said receptacles, (f) the length of each of said side-wall panels in said first direction on said blank is substantially less than the length of said support panels in said first direction and said linear groups are spaced from one another, and including a pair of reinforcement panels formed in the space between said two linear groups of sidewall panels, each of said reinforcement panels being connected at one side edge to one of said side edges of one of said support panels along a fold line, whereby each of said reinforcement panels can be folded over and secured to one of said support panels.

2. A blank as in claim 1 including a pair of side flanges, each extending along a fold line from one end of each said linear groups, said end being selected from the group consisting of the west end and the east end, when said linear groups are aligned in an east-west direction.

3. A blank as in claim 1 in which said first end edges of said support panels are joined together along a fold line.

4. A blank as in claim 1 in which each of said support panels includes at least one divider cut-out therefrom, said divider being secured at one end to the support panel from which it is cut out, said cut-out having an end opposite said one end, with an attachment tab at said opposite end for attachment to one of said side-wall panels to form a divider when said carrier is unfolded.

5. A blank as in claim 1 in which each of said corners has a shape selected from the group consisting of substantially triangular and truncated triangular.

6. A blank as in claim 1 in which each of said two flanges has a shape selected from the group consisting of substantially triangular, truncated triangular, and substantially rectangular.

7. A blank as in claim 1 in which at least one of said flanges in each of said linear groups has a width, measured in said first direction, equal to the width of the narrowest of said side wall panels, measured in said transverse direction, so that said one flange spans the width of said bottom structure when said blank is formed into a carrier and unfolded.

8. A blank as in claim 4 in which there are two of said cut-outs forming two dividers for each of said support panels, each being secured to said panel along a longitudinal fold line, said cut-outs extending in said transverse direction.

9. A blank as in claim 8 in which each of the attachment tabs of one of each pair of said dividers is substantially narrower than the base of the other of said pair of dividers, and extends into and is cut out of the material of said base of said other divider.

10. A blank as in claim 9 in which said blank has side flanges extending from one of the east and west ends of said blank, and each of the attachment tabs of said other dividers extends into and is cut out of the material of one of said side flanges.

11. A blank as in claim 4 in which each of said divider cut-outs has an elongated tapered lower extremity to serve as a cushion between beverage containers in adjacent compartments formed by said dividers.

12. A carrier blank comprising:

(a) a pair of support panels, (b) two groups of side-wall panels, each connected in series to one of said support panels so as to form, together with said support panels, a walled enclosure for a receptacle, (c) a plurality of flanges, one extending from the lower edge of each of said side wall panels and the attached support panel in each of said groups, said flanges adapted to be selectively secured to one another to form a bottom wall for one of said receptacles, (d) at least two cut-outs from the material of each of said support panels forming two dividers for each of said receptacles, each of said cut-outs being attached along a fold line at one end to support the panel from which it is cut, and having an attachment tab at the end opposite said one end, one of said dividers having a width at said attachment end which is substantially narrower than the width of said one end of the other divider, with said attachment end being nested within an cut out of the material of said other divider, (e) said side-wall panels being shorter than said support panels and separated from one another by material of which said blank is made, and a pair of reinforcement panels formed of said material, each attached along a fold line to one of said support panels to be foldable onto and securable to said one support panel as a reinforcement, each of said support panels having a handle structure adjacent the area covered by said reinforcement panel.

13. A carrier blank comprising:

(a) a pair of support panels, (b) two groups of side-wall panels, each connected in series to one of said support panels so as to form, together with said support panels, a walled enclosure for a receptacle, (c) a plurality of flanges, one extending from the lower edge of each of said side wall panels and the attached support panel in each of said groups, said flanges adapted to be selectively secured to one another to form a bottom wall for one of said receptacles, and (d) at least two cut-outs from the material of each of said support panels forming two dividers for each of said receptacles, each of said cut-outs being attached along a fold line at one end to support the panel from which it is cut, and having an attachment tab at the end opposite said one end, one of said dividers having a width at said attachment end which is substantially narrower than the width of said one end of the other divider, with said attachment end being nested within an cut out of the material of said other divider in which said other divider has an attachment tab at the end opposite said one end, the latter attachment tab extending beyond one side edge of said support panel, the latter attachment tab extending into and being cut out of the material of one of said side wall panels which spans the gap left by the cut-out of said other divider.

* * * * *